US008535252B1

(12) United States Patent
Park

(10) Patent No.: US 8,535,252 B1
(45) Date of Patent: Sep. 17, 2013

(54) THERAPEUTIC BED

(76) Inventor: Ki Dong Park, Alexandria, VA (US)

( * ) Notice: Subject to any disclaimer, the term of this patent is extended or adjusted under 35 U.S.C. 154(b) by 0 days.

(21) Appl. No.: 13/552,214

(22) Filed: Jul. 18, 2012

(51) Int. Cl.
*A61H 23/00* (2006.01)

(52) U.S. Cl.
USPC ..... 601/62; 601/49; 5/933

(58) Field of Classification Search
USPC ..... 601/46, 49, 51, 56, 59, 60, 61, 62, 601/67–70, 84, 86, 87, 89, 90, 92, 93, 97, 601/98, 101, 107, 108, 134, 136; 5/131, 5/132, 189, 190, 200.1, 933
See application file for complete search history.

(56) References Cited

U.S. PATENT DOCUMENTS 3,048,168 A * 8/1962 Kamp ..... 601/59
4,769,864 A 9/1988 Park
4,785,797 A * 11/1988 Cuervo ..... 601/60
4,958,627 A 9/1990 Park
5,140,977 A * 8/1992 Raffel ..... 601/46
6,723,059 B1 4/2004 Park

* cited by examiner

*Primary Examiner* — Quang D Thanh
(74) *Attorney, Agent, or Firm* — Birch, Stewart, Kolasch & Birch, LLP

(57) ABSTRACT

An improved therapeutic bed includes a bed frame; at least one spring holder, each extending along a first direction of the bed frame and including first channels provided at a top area of the at least one spring holder; coil springs disposed respectively in the first channels of the at least one spring holder, each of the coil springs extending along a second direction of the bed frame between two sides of the bed frame; at least one vibration shaft member disposed below the at least one coil spring holder and extending along the first direction of the bed frame; and a motor configured to generate vibration to the at least one vibration shaft member. The vibration is transferred from the at least one vibration shaft member to the coil springs through the at least one spring holder, whereby the therapeutic bed has improved durability and massaging effect.

16 Claims, 3 Drawing Sheets

THERAPEUTIC BED

BACKGROUND OF THE INVENTION

1. Field of the Invention

The present invention relates to a therapeutic bed and more particularly, to a bed with a plurality of coil springs, at least one coil spring holder, a vibration longitudinal shaft member and at least one motor that provides a massaging function to a user.

2. Description of the Related Art

Therapeutic bed is well known in the art which uses air bags or water containers. However, since air or water is displaced when pressure due to the weight of the user is applied on such mattresses, the pressure force is generally not concentrated at the desired regions of the user's body such as joints, bones, or muscles that require therapeutic massaging to relieve stress.

U.S. Pat. No. 4,769,864 issued to the present inventor discloses a therapeutic bed including a plurality of parallel wires for defining a bed floor.

U.S. Pat. No. 4,958,627 also issued to the present inventor discloses an improved therapeutic bed including a plurality of parallel rubber wires placed on a bed frame, and a vibrating motor and an intermittent hitting plate operatively associated with the rubber wires for massaging the human body.

U.S. Pat. No. 6,723,059 also issued to the present inventor discloses an improved therapeutic bed including rope elements secured to an upper surface of the bed frame.

Although these therapeutic beds offer various benefits, they may have some limitations. Specifically, there is a limitation that the rope elements secured to an upper surface of the bed frame may lose their elasticity as times goes by, which can cause shortening of the lifespan of these therapeutic beds. Further, the elasticity of the rope elements may not adequately and efficiently transmit the vibration generated by the motors to the user of the bed. Therefore, there is a need for further improving the massaging effect and the durability of a therapeutic bed.

SUMMARY OF THE INVENTION

The present invention provides a therapeutic bed having an improved massage capability and durability, which provides satisfaction to the user of the bed.

The present invention provides a therapeutic bed which addresses the limitations and disadvantages associated with the related art therapeutic beds.

According to the principles of the present invention and in accordance with one embodiment, the therapeutic bed according to an embodiment of the present invention includes a bed frame; at least one spring holder, each extending along a first direction of the bed frame and including a plurality of first channels provided at a top area of the at least one spring holder; a plurality of coil springs disposed respectively in the plurality of first channels of the at least one spring holder, each of the plurality of coil springs extending along a second direction of the bed frame between two sides of the bed frame; at least one vibration shaft member disposed below the at least one coil spring holder and extending along the first direction of the bed frame; and a motor configured to generate vibration to the at least one vibration shaft member, wherein the vibration is transferred from the at least one vibration shaft member to the plurality of coil springs through the at least one spring holder.

In accordance with another aspect of the invention, each of the at least one spring holder further includes at least one second channel provided at a bottom area of the each of the at one spring holder.

In accordance with another aspect of the invention, the at least one second channel includes a plurality of second channels provided at the bottom area of the each of the at least one spring holder, each of the plurality of second channels being disposed between two adjacent first channels among the plurality of first channels.

In accordance with another aspect of the invention, each of the at least one spring holder further includes a plurality of protruding portions for fixedly securing the each of the at least one spring holder to the at least one vibration shaft member.

In accordance with another aspect of the invention, each of the protruding portions of each of the at least one spring holder includes a plurality of thru holes for inserting therein fixing members for fixedly securing the corresponding protruding portion to the at least one vibration shaft member.

In accordance with another aspect of the invention, each of the plurality of first channels has a "C" shape.

In accordance with another aspect of the invention, the at least one spring holder includes a plurality of spring holders lined up against one another so as to form a line extending along the first direction of the bed frame.

In accordance with another aspect of the invention, the therapeutic bed further includes a plurality of supporting members respectively disposed below the plurality of coil springs, and connected to the two sides of the bed frame.

In accordance with another aspect of the invention, the therapeutic bed further includes a pair of tapered beams disposed on a top surface of each of the plurality of supporting members and below each of the plurality of coil springs, and extending along the second direction of the bed frame.

In accordance with another aspect of the invention, the first direction of the bed frame is substantially perpendicular to the second direction of the bed frame.

In accordance with another aspect of the invention, the plurality of coil springs are disposed substantially parallel to each other with certain intervals therebetween.

In accordance with another aspect of the invention, the plurality of coil springs substantially fill up a laying area of the therapeutic bed.

In accordance with another aspect of the invention, the therapeutic bed further includes pairs of connecting members fixed to inner parts of the bed frame and disposed at certain intervals along the two sides of the bed frame.

In accordance with another aspect of the invention, end parts of each of the plurality of coil springs are engaged with each pair of the connecting members.

In accordance with another aspect of the invention, the bed frame includes a pair of longitudinal frames, a pair of traverse frames connected to the pair of longitudinal frames, and a plurality of base legs connected at least one of the longitudinal frames and the traverse frames.

In accordance with another aspect of the invention, the motor is disposed below a middle area of the at least one vibration shaft member.

In accordance with another aspect of the invention, only one motor is provided in the therapeutic bed.

Other objects and further scope of applicability of the present invention will become apparent from the detailed description given hereinafter. It should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given below and the accompanying drawings are given by way of illustration only and thus are not limitative of the present invention, and wherein.

DETAILED DESCRIPTION OF THE PREFERRED EMBODIMENTS

For the purpose of illustrating the preferred embodiments of present invention, the drawings will be described in great detail.

Figure 1:
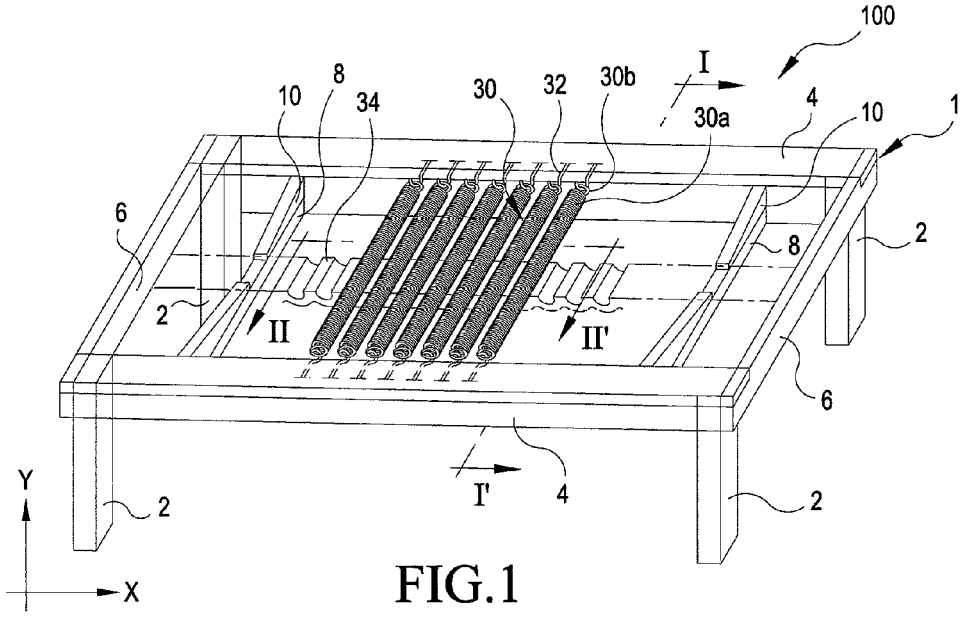
FIG. 1 is a perspective view of a therapeutic bed according to one embodiment of the present invention.

FIG. 1 illustrates a perspective view of a therapeutic bed 100 according to one embodiment of the present invention.

As shown in FIG. 1, the therapeutic bed 100 includes a bed frame 1 having a plurality of base legs 2, a pair of longitudinal frames 4 connected to the base legs 2 and extending along an X-direction, and a pair of traverse frames 6 connected to the base legs 2 and the longitudinal frames 4 and extending along a Y-direction. These components of the bed frame 1 can be fixedly attached using known attaching techniques or can be formed integrally.

Further, the therapeutic bed 100 includes a plurality of coil springs 30, each extending along the Y-direction. Each coil spring 30 includes a coil spring part 30*a* and two end parts 30*b* disposed at the ends of the coil spring part 30*a*. The coil spring part 30*a* is composed of a spring that is coiled and extending along the Y-direction. The two end parts 30*b* of each coil spring 30 are fixedly and respectively attached to the pair of longitudinal frames 4. Preferably the coil springs 30 are lined up parallel or substantially parallel to each other with certain spaces therebetween, and are disposed along the entire length (X-direction) of the frame 1 so as to occupy the entire space (or substantial portion thereof) between the pair of traverse frames 6. The coil springs 30 could be made of any materials that have good physical properties such as elasticity and tensile strength.

The therapeutic bed 100 further includes one or more coil spring holders 34 extending in the X-direction of the bed 100, and one or more longitudinal shaft members 40 (see FIG. 2) which are disposed below and connected to the coil spring holders 34 and extend in the same X-direction. Each coil spring holder 34 has a plurality of channels 36 (see FIG. 4) for receiving therein the coil springs 30 respectively. The coil spring holder 34 will be described later in more detail referring to FIGS. 3 and 4.

The therapeutic bed 100 further includes at least one motor 50 (shown in FIG. 3) which is connected to the longitudinal shaft members 40 connected to the coil spring holder(s) 34. The motor 50 preferably is a vibrating motor or a motor that generates vibration. Thus, when the motor 50 is activated to generate vibration (e.g., when the user turns on a switch), this vibration is transferred to the longitudinal shaft member(s) 40 due to the connection between the motor(s) 50 and the shaft member(s) 40. Then due to the connection between the shaft member(s) 40 and the coil spring holder(s) 34, the vibration is further transferred from the shaft member(s) 40 to the coil spring holder(s) 34, which in turn cause the coil springs 30 disposed on the coil spring holder(s) 34 to vibrate.

The vibration of the coil springs 30 provides a massaging effect to a user who lies on the therapeutic bed 100. Preferably to provide cushion, some layer of cushion, pad, foam mattress, blanket, etc. is provided over the coil springs 30 so as to cover the entire laying area of the bed 100. The user then can lie on the cushion layer of the bed 100 above the vibrating coil springs 30, e.g., in the X-direction so as to enjoy the vibrating and massaging effects of the bed 100.

Figure 2:
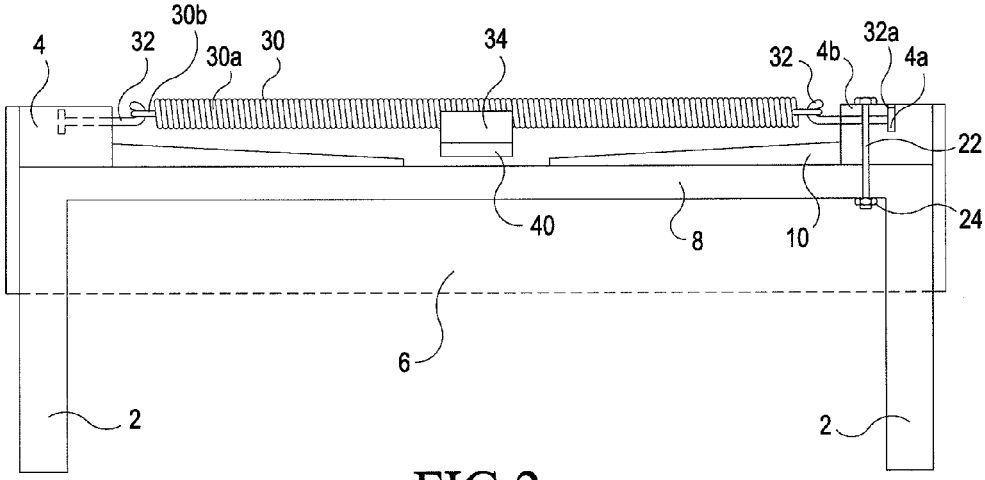
FIG. 2 is a sectional view taken along line I-I' of FIG. 1.

FIG. 2 is a sectional view taken along line I-I' of FIG. 1 according to an embodiment of the present invention.

As shown in FIG. 2, under each coil spring 30, a supporting member 8 extending in the Y-direction is disposed. The ends of the supporting members 8 are connected to the inner sides of the longitudinal frames 4 respectively. In one example, the plurality of the supporting members 8 are respectively positioned directly below the plurality of coil springs 30. The supporting members 8 are lined up parallel with each other at certain intervals, along the entire length direction (X-direction) of the bed 100, and are fixed to the longitudinal frames 4. Further, a pair of tapered beams 10 is mounted on the top surface of each of the supporting members 8. Thus, under each coil spring 30, one pair of tapered beams 10 and the supporting member 8 may be provided. The thicker sides of the pair of tapered beams 10 are attached to the inner sides of the longitudinal frames 4. The beams 10 are preferably tapered so as to create sufficient space in which the coil springs 30 can vibrate.

Thus, by providing the plurality of supporting members 8 that are disposed directly under the coil springs 30 and are fixed to the longitudinal frames 4, the structural integrity and durability of the bed frame 1 is strengthened. Further, by providing the tapered beams 10 under each coil spring 30, the structural stability and durability of the bed frame 1 is further improved while providing a sufficient area in which the coil springs 30 can vibrate, which is beneficial.

To securely fix the coil springs 30 to the longitudinal frames 4, a plurality of connecting members 32 are mounted along the inner sides of the longitudinal frames 4. The connecting members 32 can be hooks, loops, or any other known mechanism for securely fixing component to each other. In the example of FIG. 2, a row of the connecting members 32 is disposed along each of the two inner sides of the frames 4 so that the connecting members 32 can be engaged with the end parts 30*b* of the coil springs 30. Particularly, a head 32*a* of each connecting member 32 is disposed within each slot 4*a* provided in each of the longitudinal frames 4 so that the connecting members 32 can be fixed to the longitudinal frames 4. The connecting members 32 are further attached securely to the longitudinal frames 4 by a plurality of plates 4*b* and are fastened by one or more bolts 22 and nuts 24 or other fastening means to the bed frame 1. As a result, the coil springs 30 are securely and operatively connected to the bed frame 1. Since the coil springs 30 have great elasticity and durability compared to rubber wires or ropes of the related art, the bed 100 having such coil springs 30 according to the present invention greatly improves the transmission of vibration created by the motor 50 to the user lying on the therapeutic bed 100.

Figure 3:
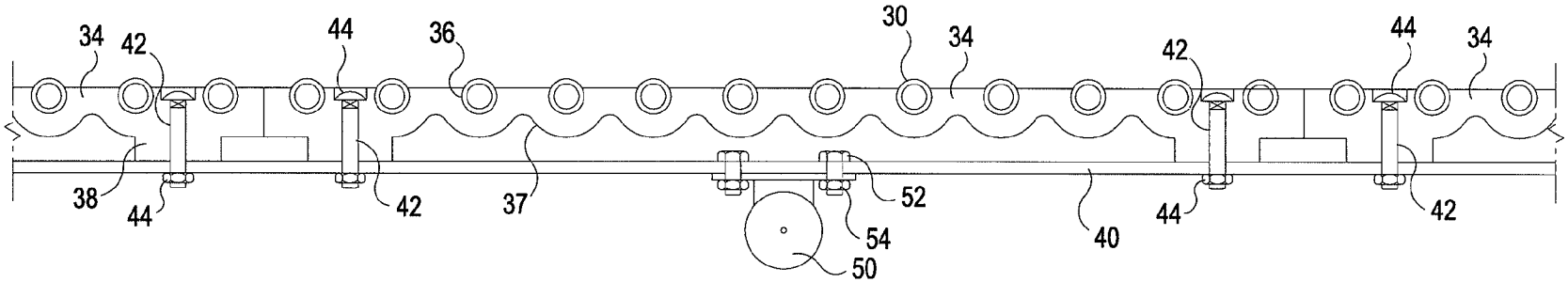
FIG. 3 is a sectional view taken along line II-II' of FIG. 1.

FIG. 3 is a sectional view taken along line II-II' of FIG. 1 according to an embodiment of the present invention and FIG.

4 is a perspective view of one example of the coil spring holder 34 of the therapeutic bed of FIG. 1.

As shown in FIG. 3, the therapeutic bed 100 includes one or more coil spring holder 34 for supporting the plurality of coil springs 30. Each coil spring holder 34 includes a plurality of first channels (or grooves) 36 disposed on a top portion of the spring holder 34 for receiving the coil springs 30 therein. The shape of each of the first channels 36 can vary as long as it can securely hold the coil springs 30 therein. For instance, the first channels 36 can be in a shape of a partial or substantial cylinder such that each first channel 36 defines a shape of letter "C". Further, each coil spring holder 34 includes a plurality of second channels 37 disposed on a bottom portion of the spring holder 34, and a plurality of protruding portions 38 disposed on a bottom end portion of the spring holder 34 for securely fixing the spring holder 34 to the shaft member(s) 40 via bolts and nuts 42 and 44.

Figure 4:
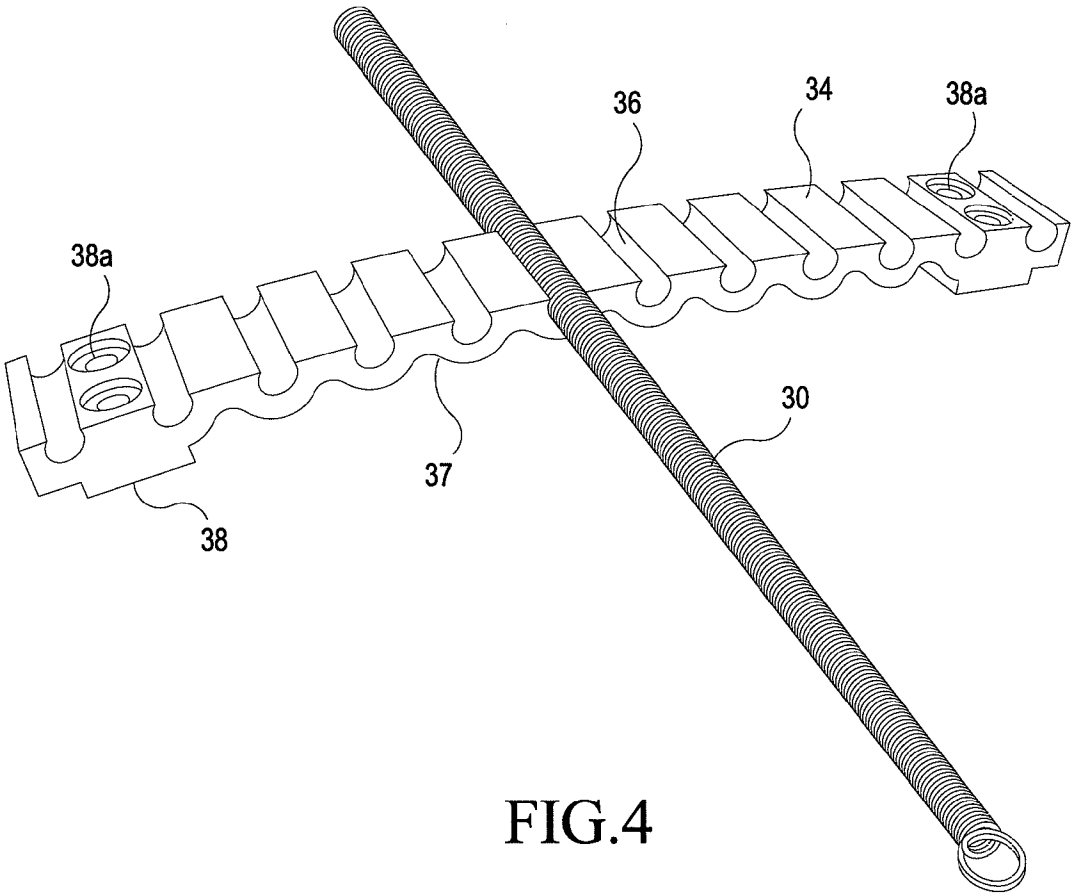
FIG. 4 is a perspective view of one example of a coil spring holder of the therapeutic bed of FIG. 1.

Preferably, the second channels 37 could be made on the bottom portion of the spring holder 34 at respective positions between the first channels 36 formed on the top portion of the spring holder 34. The length of the coil spring holder 34 can vary depending on the number of coil springs 30 needed for the entire bed frame 1. The bed frame 1 can have a single coil spring holder 34 that extends along the entire length of the bed frame 1 (X-direction) to support the coil springs 30 therein, or can include a plurality of coil spring holders 34 aligned next to each other to extend along the entire length of the bed frame 1 as shown in FIG. 3. FIG. 4 shows an example of a coil spring holder 34 having a fixed length and configuration, which can be used in the latter case.

For instance, as shown in FIG. 4, each coil spring holder 34 can have a fixed number of the first channels 36 (e.g., twelve first channels), a fixed number of the second channels 37 (e.g., nine second channels) disposed between the first channels 36, a fixed number of the protruding portions 38 (e.g., two protruding portions). In this example, each of the protruding portions 38 has a pair of thru holes 38*a* for receiving the bolts 42 and nuts 44 (or other fasteners) used to securely fix the coil spring holder 34 to the shaft member(s) 40. A plurality of the coil spring holders 34 of FIG. 4 can then be disposed to abut against each other along the length direction (e.g., X-direction) of the bed frame 1 as shown in FIG. 3. These spring holders 34 can receive the coil springs 34 in their first channels 36. In one example, about six or more of the spring holders 34 of FIG. 4 can be lined up along the X-direction of the bed frame 1. Preferably, the line of the spring holders 34 can cross a middle area of the bed frame 1 along the entire length direction of the bed frame 1, so that the coil springs 30 are securely disposed in the bed 100. In another example, multiple parallel lines of the spring holders 34 may cross the bed frame 1 along the entire length direction (X-direction0 of the bed frame 1 to support the coil springs 30 therein at multiple locations.

The shape of the first channels 36 of the spring holders 34 functions to hold the coil springs 30 securely. In one example, since the shape of the first channels 36 is the letter "C" or the like, the coil springs 30 are securely disposed in the first channels 36 without being easily removable therefrom. The bottom surface configuration of the spring holder 34 having the second channels 37 allows the coil spring holder 34 (or a substantial portion thereof) to be separated from the portion of the vibration longitudinal shaft member(s) 40 so that a substantial part of the coil spring holder 34 can vibrate without contacting the vibration longitudinal shaft member 40. At the same time, since the protruding portions 38 of the spring holder 34 are securely fixed to the portions of the shaft member 40, the vibration of the shaft member 40 (due to the vibration of the motor 50) can be effectively transferred to the spring holder 34 for vibrating the coil springs 30.

Therefore, the transmission of the vibration from at least one motor 50 to the user lying on the therapeutic bed 100 is improved efficiently and smoothly. In addition, since the coil spring holder(s) 34 securely hold the coil springs 30 for vibration, the balanced or uniform vibration can be generated by the coil springs 30. Accordingly, by introducing the coil spring holder(s) 34 and the coil springs 30 in the therapeutic bed 100, the present invention improves the transmission of vibration synergistically and efficiently along the entire bed 100 so that an improved and cost-effective therapeutic bed having a messaging function is created.

As shown in FIG. 3, the vibration longitudinal shaft member 40 is fixedly attached to the protruding portions 38 of the coil spring holder 34. This fixing can occur using any known fixing technique, e.g., bolts 42 and nuts 44 or other known fasteners as discussed above. The vibration longitudinal shaft member 40 could be made of any material capable of transmitting the vibration of the motor to the spring holder 34. One or more shaft members 40 can be disposed below the spring holders 34, and can have any length and/or width to correspond with the length and/or width of the coil holder(s) 34 extending along the bed frame 1.

The motor 50 is attached below the vibration longitudinal shaft member(s) 40. Preferably, only one motor 50 is used for each therapeutic bed 100 since the transmission of the vibration from the motor 50 to the coil springs 30 is effectively made in the present invention. However, if desired, multiple motors 50 may be used. Further, due to the use of the one motor 50, electric power used by the therapeutic bed 100 can be reduced, which can save the operation cost of the bed 100 for the user. The motor 50 can be disposed below the vibration longitudinal shaft member(s) 40 by using fasteners such as bolts 52 and nuts 54. In this regard, other fastening members can be used. The motor 50 could be disposed anywhere below or adjacent to the vibration longitudinal shaft member(s) 40. Preferably, the motor 50 may be disposed at a center area of the bed 100 below the vibration longitudinal shaft member(s) 40 for an effective transmission of the motor vibration to the entire therapeutic bed 100. However, other locations are possible for the motor 50.

Figure 5:
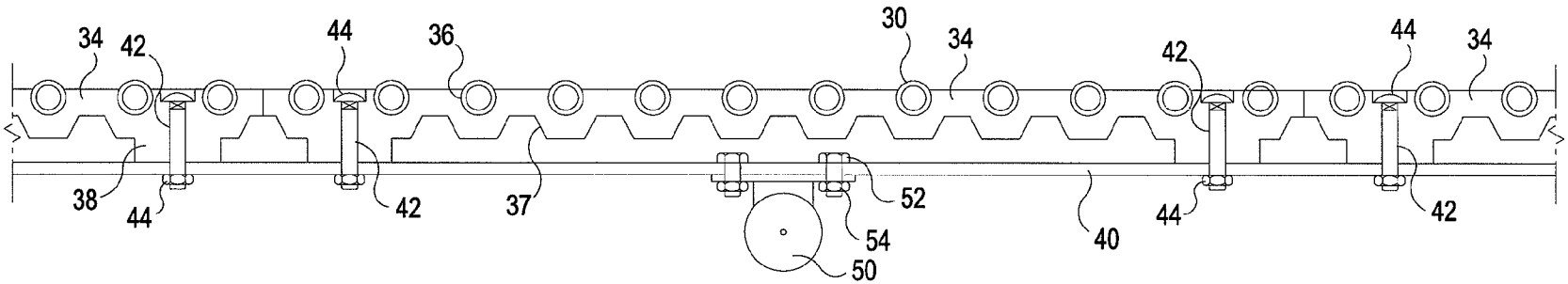
FIG. 5 is a sectional view taken along line II-II' of FIG. 1 showing another example of a coil spring holder of the therapeutic bed according to one embodiment of the present invention.

FIG. 5 is a sectional view taken along line II-II' of FIG. 1 showing another example of the coil spring holder of the therapeutic bed according to one embodiment of the present invention. The coil spring holder of FIG. 5 is the same as that of FIG. 3, except that the shape of the second channels 37 is different from that of FIG. 3. In FIG. 5, the second channels 37 have a trapezoidal shape. However, other shapes are possible, such as semi-circle, a rectangle, etc. In another example, the coil spring holder 34 can be without the second channels 37 such that it has a single flat bottom surface below the coil springs 30.

Although the therapeutic bed 100 shown in FIG. 1 is in a rectangular shape, the therapeutic bed 100 can be in any other shape such as a square, an oval, etc. Further, although the therapeutic bed 100 of FIG. 1 has four base legs, the present invention is not limited thereto and can have other numbers depending on the shape, size and design of the bed. Moreover, any number of coil springs, coil spring holders, fasteners, first channels, second channels, protruding portions, motor, etc. can be used in the various embodiments of the present invention, and can have various shapes, sizes, and configurations as needed.

Therefore, the present invention provides an improved therapeutic bed. The transmission of the vibration and durability of the therapeutic bed is improved through introducing the coil springs 30 and the uniquely designed coil spring holder(s) 34 for the coil springs 30. Consequently, the user can enjoy the improved therapeutic bed that has a better massaging effect and durability in a cost-effective manner.

The present invention is by no means restricted to the above-described preferred embodiments, but covers all variations that might be implemented by using equivalent functional elements or devices that would be apparent to a person skilled in the art, or modifications that fall within the spirit and scope of the appended claims.

What is claimed is:

1. A therapeutic bed comprising:

a bed frame;

at least one spring holder, each extending along a first direction of the bed frame and including a plurality of first channels provided at a top area of the at least one spring holder;

a plurality of coil springs disposed respectively in the plurality of first channels of the at least one spring holder, each of the plurality of coil springs extending along a second direction of the bed frame between two sides of the bed frame;

at least one vibration shaft member disposed below the at least one coil spring holder and extending along the first direction of the bed frame; and a motor configured to generate vibration to the at least one vibration shaft member, wherein the vibration is transferred from the at least one vibration shaft member to the plurality of coil springs through the at least one spring holder, and wherein each of the at least one spring holder further includes at least one second channel provided at a bottom area of the each of the at least one spring holder.

2. The therapeutic bed as claimed in claim 1, wherein the at least one second channel includes a plurality of second channels provided at the bottom area of the each of the at least one spring holder, each of the plurality of second channels being disposed between two adjacent first channels among the plurality of first channels.

3. The therapeutic bed as claimed in claim 1, wherein each of the at least one spring holder further includes a plurality of protruding portions for fixedly securing the each of the at least one spring holder to the at least one vibration shaft member.

4. The therapeutic bed as claimed in claim 3, wherein each of the protruding portions of each of the at least one spring holder includes a plurality of thru holes for inserting therein fixing members for fixedly securing the corresponding protruding portion to the at least one vibration shaft member.

5. The therapeutic bed as claimed in claim 1, wherein each of the plurality of first channels has a "C" shape.

6. The therapeutic bed as claimed in claim 1, wherein the at least one spring holder includes a plurality of spring holders lined up against one another so as to form a line extending along the first direction of the bed frame.

7. The therapeutic bed as claimed in claim 1, further comprising:

a plurality of supporting members respectively disposed below the plurality of coil springs, and connected to the two sides of the bed frame.

8. The therapeutic bed as claimed in claim 7, further comprising:

a pair of tapered beams disposed on a top surface of each of the plurality of supporting members and below each of the plurality of coil springs, and extending along the second direction of the bed frame.

9. The therapeutic bed as claimed in claim 1, wherein the first direction of the bed frame is substantially perpendicular to the second direction of the bed frame.

10. The therapeutic bed as claimed in claim 1, wherein the plurality of coil springs are disposed substantially parallel to each other with certain intervals therebetween.

11. The therapeutic bed as claimed in claim 10, wherein the plurality of coil springs substantially fill up a laying area of the therapeutic bed.

12. The therapeutic bed as claimed in claim 1, further comprising:

pairs of connecting members fixed to inner parts of the bed frame and disposed at certain intervals along the two sides of the bed frame.

13. The therapeutic bed as claimed in claim 12, wherein end parts of each of the plurality of coil springs are engaged with each pair of the connecting members.

14. The therapeutic bed as claimed in claim 1, wherein the bed frame includes:

a pair of longitudinal frames, a pair of traverse frames connected to the pair of longitudinal frames, and a plurality of base legs connected at least one of the longitudinal frames and the traverse frames.

15. The therapeutic bed as claimed in claim 1, wherein the motor is disposed below a middle area of the at least one vibration shaft member.

16. The therapeutic bed as claimed in claim 1, wherein only one motor is provided in the therapeutic bed.

* * * * *